US006089526A

United States Patent [19]

Olson

[11] Patent Number: 6,089,526

[45] Date of Patent: Jul. 18, 2000

[54] RAM TYPE BLOWOUT PREVENTOR

[75] Inventor: Richard A. Olson, Houston, Tex.

[73] Assignee: Stewart & Stevenson Services, Inc., Houston, Tex.

[21] Appl. No.: 09/056,842

[22] Filed: Apr. 9, 1998

Related U.S. Application Data

[60] Provisional application No. 60/045,244, May 1, 1997.

[51] Int. Cl.[7] ..... E21B 1/22

[52] U.S. Cl. ..... 251/1.3; 251/1.1

[58] Field of Search ..... 251/1.1, 1.3

[56] References Cited

U.S. PATENT DOCUMENTS

| | | | |
|---|---|---|---|
| 3,434,729 | 3/1969 | Shaffer et al. | 277/181 |
| 3,897,038 | 7/1975 | Le Rouax | 251/1 |
| 3,897,039 | 7/1975 | Le Rouax | 251/1 |
| 3,915,424 | 10/1975 | Le Rouax | 251/1 |
| 3,915,425 | 10/1975 | Le Rouax | 251/1 |
| 3,915,426 | 10/1975 | Le Rouax | 251/1 |
| 4,089,532 | 5/1978 | Kamyshnikov et al. | 277/129 |
| 4,229,012 | 10/1980 | Williams, III | 277/127 |
| 4,332,367 | 6/1982 | Nelson | 251/1 |
| 4,444,404 | 4/1984 | Parks, Jr. | 277/135 |
| 4,550,895 | 11/1985 | Shaffer | 251/1.3 |
| 4,579,314 | 4/1986 | Schaeper et al. | 251/1.2 |
| 4,930,745 | 6/1990 | Granger et al. | 251/1.2 |
| 5,005,802 | 4/1991 | McWhorter et al. | 251/1.3 |
| 5,011,110 | 4/1991 | Le | 251/1.1 |
| 5,044,603 | 9/1991 | Granger et al. | 251/1.3 |
| 5,064,164 | 11/1991 | Le | 251/1.1 |
| 5,294,088 | 3/1994 | McWhorter et al. | 251/1.3 |

*Primary Examiner*—John Fox
*Attorney, Agent, or Firm*—Browning Bushman

[57] ABSTRACT

There is disclosed a ram type blowout preventor whose rams have variable ram packers for sealing about pipes of difference sizes in the bore of the preventor housing. Each ram packer includes a body of elastomeric material installed with a slot across the face of a metal ram body slidable with a guideway intersecting the bore of the preventor body. First and second sets of metal segments embedded in the body of elastomeric material beneath a top plate embedded in the packer body are so constructed and arranged as to prevent extrusion of the elastomeric material as the packers seal about the different sizes of pipe.

25 Claims, 4 Drawing Sheets

RAM TYPE BLOWOUT PREVENTOR

This Application claims the benefit of U.S. Provisional Application Ser. No. 60/045,244 filed May 1, 1997.

This invention relates generally to a ram type blowout preventor (BOP), and, more particularly to improvements in a BOP of this type having rams with variable ram packers.

In a typical ram type BOP, a pair of opposed rams are mounted in guideways extending from the bore of a housing installed at the head of a well, each ram including a metal body slidable in a guideway in the housing and carrying a packer in a cavity across its front face for sealably engaging the front face of the packer of the opposed ram as the rams are moved toward one another to closed position. In the case of pipe rams, the front faces of the packers have recesses for sealing about a given size of pipe, as well as with one another. Hence, during drilling of a well, it is necessary, in the case of conventional BOP's, to "change out" the rams and/or preventors as different sizes of pipe are being used.

To avoid this delay and expense, it has been proposed to provide BOPs with ram packers of such construction as to enable them to close and seal about a range of pipe sizes, known as variable ram packers. Thus, metal inserts or segments are embedded in the elastomeric packer body about its recess and beneath an upper metal plate across the top of the body so that, as the front faces of the ram packers are forced inwardly against one another to compress the body of the packer, the inserts are forced inwardly with the body of elastomeric material to bridge any gap between the recess in the face of the ram body and pipes of different sizes, and thus prevent the material from being extruded between the ram faces and pipe.

In the ram type BOP of U.S. Pat. No. 5,005,802 dated Apr. 9, 1991, each of the variable ram packers has two or more sets of inserts or segments embedded one above the other in the body of elastomeric material beneath the upper plate. More particularly, the segments are spaced apart and arranged to move both circumferentially as well as radially with respect to one another, as the rams are moved toward closed position, between positions in which the inner end edges of each set are engaged with a pipe of "preselected" size. In one position of the variable ram packer for sealing about a pipe of a diameter approaching that of ram body recess, the upper plate itself provides the only support against extrusion.

An object of this invention is to provide of a ram type blowout preventor having variable bore rams in which the metal segments embedded in the body of elastomeric material of each ram packer are so constructed and arranged as to provide support against the extension of the elastomeric material over a full range of pipe sizes without reliance on the upper plate.

Another object is to provide such rams and packers for use as replacement parts.

These and other objects are accomplished by a blowout preventor of the type described, wherein each pipe ram has, as in prior BOP's, a body of elastomeric material fitting closely within a slot across the front face of the metal ram body and having a vertical recess in its inner end aligned with and protruding from the recess in the ram body, so that the recesses in both close about a pipe in the bore of the housing as the rams move inwardly to closed position. More particularly, as in rams of this type, a metal plate embedded in the top surface of the packer body has a vertical recess therein rearwardly but generally aligned with the recess in the face of the packer body, and first and second sets of radially extending metal segments are embedded within the packer body below the metal plate and with their front edges forming a vertical recess generally aligned with and inwardly of the recess in the metal plate but outwardly of the recess in the packer body.

In accordance with the preferred and illustrated embodiment of the invention, however, and as compared with those of the ram packer of this aforementioned patent, the segments of each set have generally radially extending side edges circumferentially spaced from one another and overlapping those of adjacent segments of the other set, when the packer body is in its relaxed condition, so as to prevent the formation of gaps through which the elastomeric material might extrude as the packer body is distorted upon closure of the recesses in the elastomeric bodies upon a range of pipe diameters greater or less than that of the diameter of the recess in the ram packer body. Thus, each of the segments of the first set has a wedge-shaped rib on the one side thereof which is generally intermediate its side edges and which has essentially radially extending side edges which are disposed between and circumferentially spaced from essentially radially extending sides of adjacent segments of the second set.

Preferably, the radially outer end edge of each segment of the first set also has an outwardly protruding portion generally intermediate its side edges, and each of the segments of the second set has a vertical flange on the radially outer end edge thereof intermediate the protruding portion on an adjacent segment of the first set and adjacent the radially outer edges, of adjacent segment of the first set to cause the segments of the first set to be moved inwardly with the segments of the second set. More particularly, the radially outer end edge of each segment of the first set has an outwardly protruding portion generally intermediate its side edges, and each of the segments of the second set has a vertical flange on the radially outer end edge thereof intermediate the protruding portion on an adjacent segment of the first set and adjacent the radially outer edges, of adjacent segment of the first set to cause the segments of the first set to be moved inwardly with the segments of the second set. As illustrated, the radially inner end edges of the segments of both sets are preferably curved to the same radius and vertically aligned with one another in the relaxed state of the elastomeric packer body.

As previously mentioned, the rams and/or the ram packers may be provided as replacement parts for existing ram type BOP's, and the packers may be provided for replacing worn packers of the rams of the BOP. Additionally, an assembly of the segments may be provided for molding within the body of elastomeric material.

In the accompanying drawings, wherein like reference characters are used throughout to designate like parts:

Figure 1:
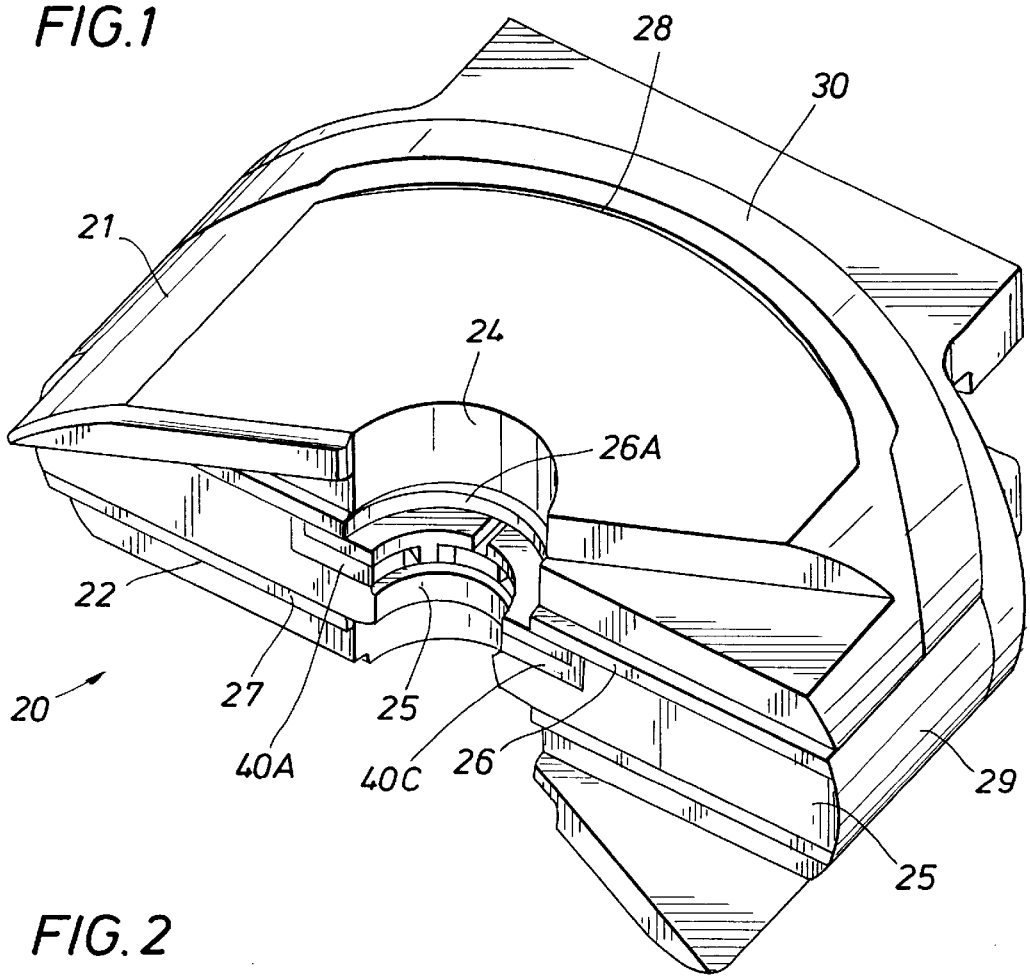
FIG. 1 is a perspective view from the top and one side of a pipe ram having a ram packer constructed in accordance with the preferred and illustrated embodiment of the present invention.
Figure 2:
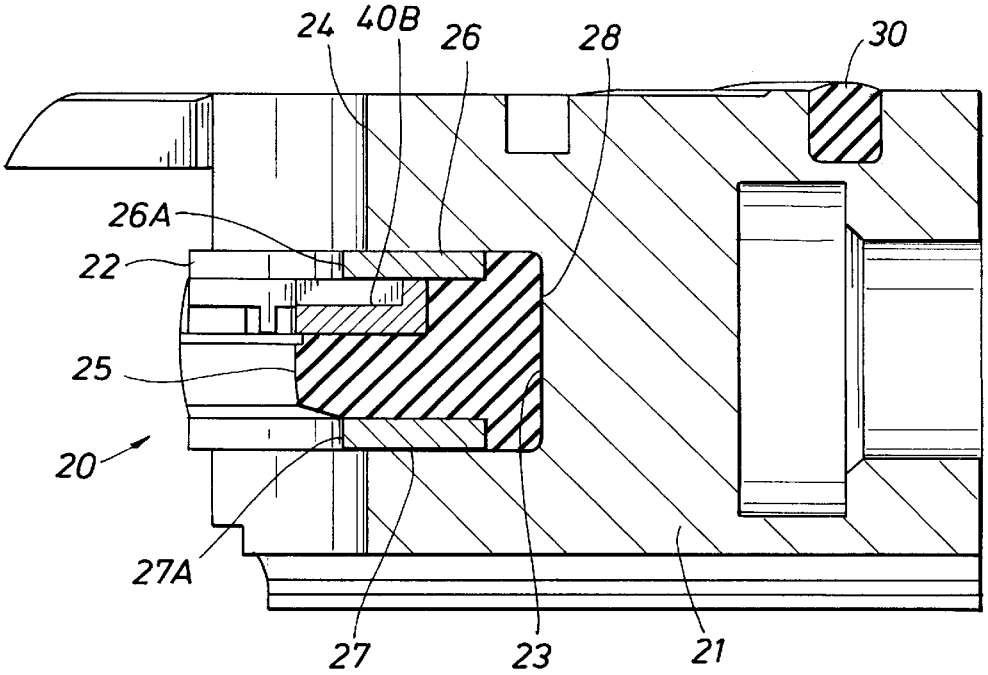
FIG. 2 is a vertical sectional view of the ram of FIG. 1 as seen along a plane perpendicular to its axis of movement.

With reference now to the details of the above-described drawings, the ram shown in FIGS. 1 and 2, and indicated in its entirety by reference character 20, is adapted to be mounted within a guideway to one side of a bore through a blowout preventor housing and opposite a similarly disposed ram in an oppositely facing guideway of the preventor housing. As well known in the art, and as shown for example, in the aforementioned U.S. patent, each of the rams is adapted to be moved inwardly and outwardly within its guideway by means of a suitable operator of the preventor adapted to be connected as by T-slots to the outer end of the ram. More particularly, as described above, each of the rams has a vertical recess in its face adapted to sealably close about a pipe within the bore of the preventor body, as well as with respect to the oppositely facing ram and its guideway, to thereby close off the bore of the preventor housing in its closed position.

As well known in the art, each ram includes a metal ram body 21 of generally oval shape adapted to guidably slide within the BOP housing guideway, and a ram packer 22 received within a lateral slot 23 across the front face of the ram body. The ram body in turn has vertical recess 24 formed in its front face coaxial with a recess 25 in the front face of the ram packer, with the ram packer protruding inwardly from the recess 24 to form initial contact with the pipe. As will be described to follow, the ram packing is removably disposed within the cavity by rods R at each side connecting it to the ram body by means of vertical pins body (not shown) in the ram body.

The ram packer 22 includes a body of rubber or other elastomeric material which extends laterally from one side to the other of the metal body between upper and lower plates 26,27 embedded in its upper and lower surfaces adjacent the top and bottom of the slot 23 in which the packer is received. The packer body has a mid-section whose arcuate outer side 28 is adapted to fit closely within an arcuate central portion of the ram body slot and laterally and outwardly extending sides 29 which, upon installation of the ram packer on the metal body of the ram, provide surfaces along the sides of the ram for sealing with respect to the ram guideway, in the preventor housing when the rams are in closed sealing position, as well as a top strip 30 extending across the top of the ram body to connect with the side packing 29.

The recess 25 in the rubber body of the packer protrudes from the recesses in the plates 26 and 27 which slidably engage the upper and lower sides of the rubber body for slidably engaging the upper and lower sides of the cavity 23 as they move relatively with respect thereto upon closing of the rams, as will be described to follow. The plates have arcuate recesses 26A and 27A in their inner ends which protrude inwardly from the ram body recess 24.

The outer ends of the rods R (FIG. 3) are connected to pins which extend through vertical holes in the ram body and into elongated notches N (see FIG. 3) formed therein to receive the pins to enable the face of the ram to move inwardly and outwardly relative to the preventor housing when the rams are forced against one another into sealing position about different sizes of pipe. The rods are connected at their inner ends to pins 30 anchored at their ends to the upper and lower plates 26 and 27.

As previously described, and as shown in the drawings, the ram packer also includes metal segments embodied within the resilient body beneath the upper plate and about its recess. More particularly, and as will be described to follow, the arcuate inner ends of the inserts cooperate to form an arcuate recess which is generally aligned with the recess in the resilient body 25 of the ram packer. Thus, the inserts move inwardly and outwardly therewith, but are nevertheless free to move radially as well as circumferentially with respect thereto and one another during movement of the rams into sealing engagement about pipes of different sizes.

Figure 5:
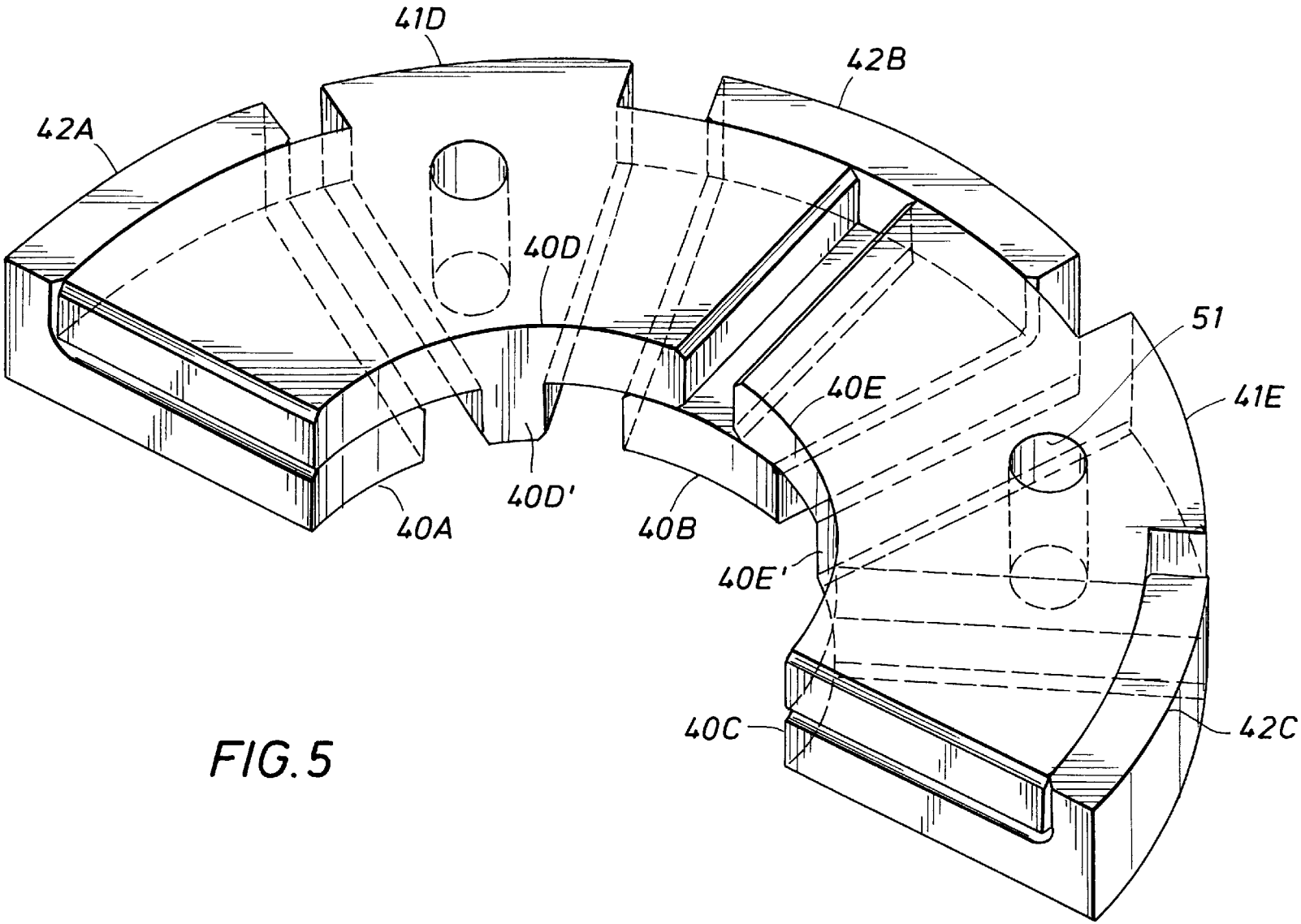
FIG. 5 is a perspective view of the metal inserts of the ram packer removed from between the upper and lower plates of the ram packer.

As best shown in FIG. 5, there are two sets of metal inserts, a first of which are essentially triangular shape and the second of which are generally "T" shaped. More particularly, the first set comprises three triangular shaped insert segments 40A,40B and 40C which are spaced circumferentially apart, and a second set of "T" shaped circumferentially spaced segments 40D and 40E whose upper laterally extending portions overlap adjacent to triangular segments 40A,40B and 40C, and whose lower depending ribs or legs 40D' and 40E' are disposed circumferentially between them. Thus, the side edges of insert segments 40D overlap and are spaced between the side edges of segments 40A and 40B, and the side edges of insert segments 40E overlap and are spaced between the side edges of insert segments 40B and 40C.

Figure 3:
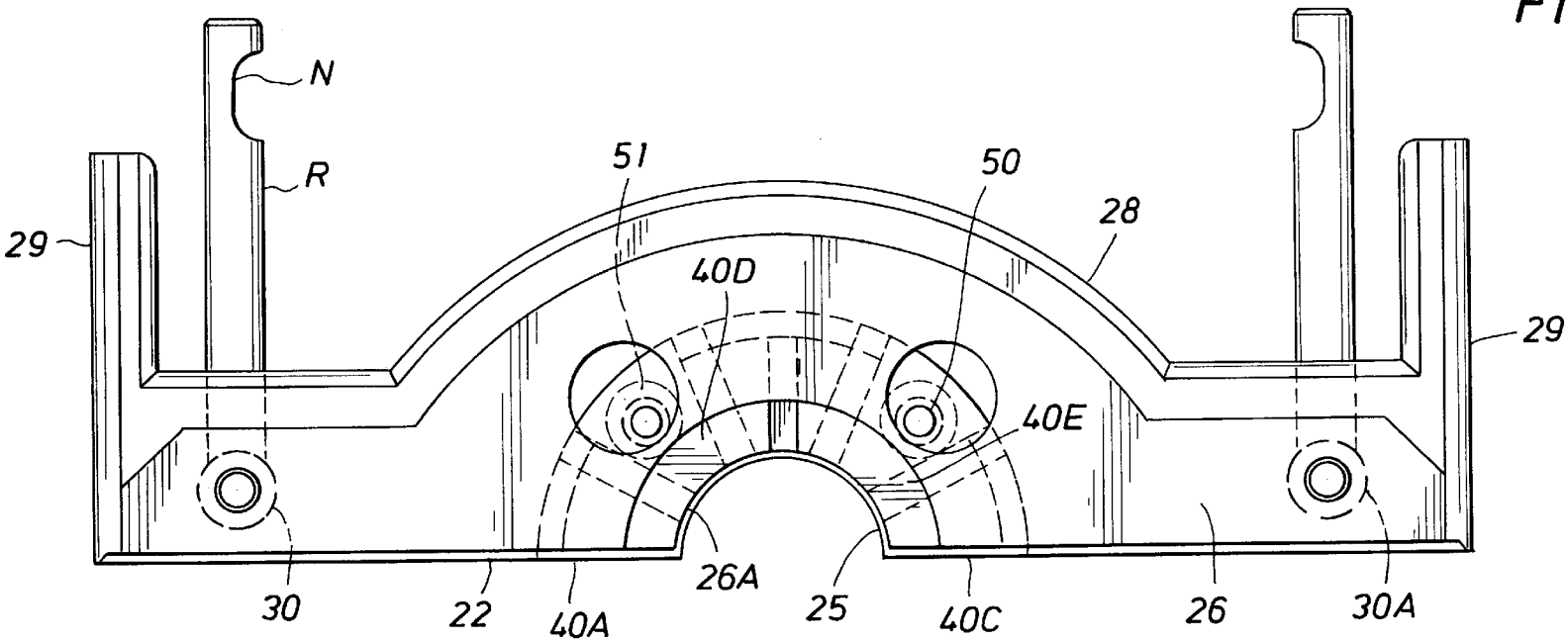
FIG. 3 is a top plan view of the ram packer removed from the ram body.
Figure 4:
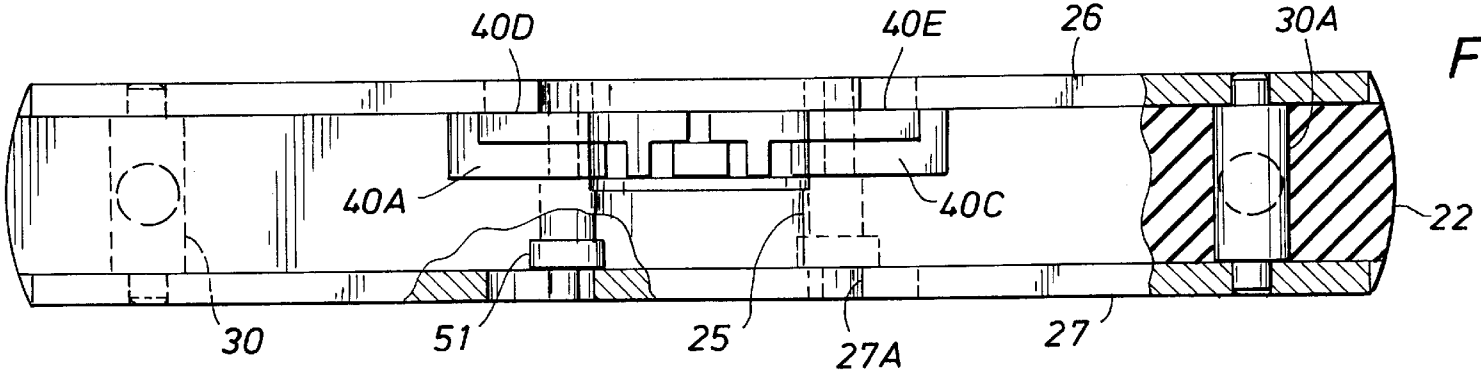
FIG. 4 is a front view of the ram packer of FIG. 3.

More particularly, the insert segments are shown in FIGS. 3 and 5 in the positions they would occupy when the packer body is relaxed—i.e., neither distorted inwardly nor outwardly to engage a pipe. In this position, the radially outer end edges of the segments 40D and 40E are vertically aligned with the radially outer end edges of the triangular sections 40A and 40C, while the radially inner end edges of the segments 40D and 40E are circumferentially spaced apart from one another generally along the radial mid-portion of the triangular segment 40B. The radial outer end edges of each of the segments 40D and 40E have protrusions 41D and 41E generally intermediate the side edges of upwardly formed flanges 42A, 42B and 42C on the radially outer ends of adjacent "T" shaped segments 40A, 40B and 40C.

Thus, in the relaxed position, the adjacent side edges of the "T" shaped segments and the triangular shaped segments are circumferentially overlapped and spaced apart generally equal distances. As will be better understood from FIGS. 6A to 6E, this insures that, during relative radial and circumferential movement of the insert segments with respect to one another, as the ram is moved to seal about different sizes of pipe, the inserts cooperate to avoid spaces between them through which the rubber material of the packer body might extrude, as the plates are moved radially inwardly from the position of FIG. 5 or outwardly therefrom to seal about a larger pipe. Pins 50 extend through holes 51 in the segments 40*d* and 40*e* to receive pins 51 which assist in maintaining alignment of the segments as they are molded within the packer body.

As in conventional ram packers, as the rams are moved inwardly, to close about a pipe, a portion of the resilient body of the packer body is compressed against the arcuate recess 23 in the ram body to cause the body to flow toward the guideways as well as inwardly against the pipe. The metal inserts embedded in the packer body move radially inwardly with the elastomeric material and into engagement about the pipe in the recess. The inner ends of the inserts, whether of the triangular of the "T" shaped type, are each curved to the same radius. The flanges 42A,42B and 42C will, during compression of the ram packer, insure that the segments 40A, 40B and 40C move inwardly with them.

Figure 6A:
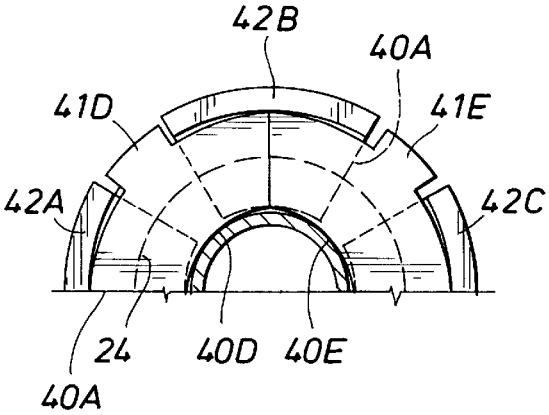
FIGS. 6A, 6B, 6C, 6D and 6E are diagrammatic views of the metal inserts, as viewed from the top, and upon movement inwardly with the ram packer to anti-extrusion positions with respect to different sizes of pipe to be sealed by the ram packer.
Figure 6B:
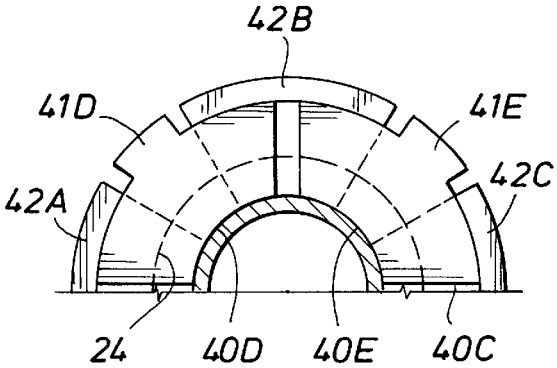
Figure 6C:
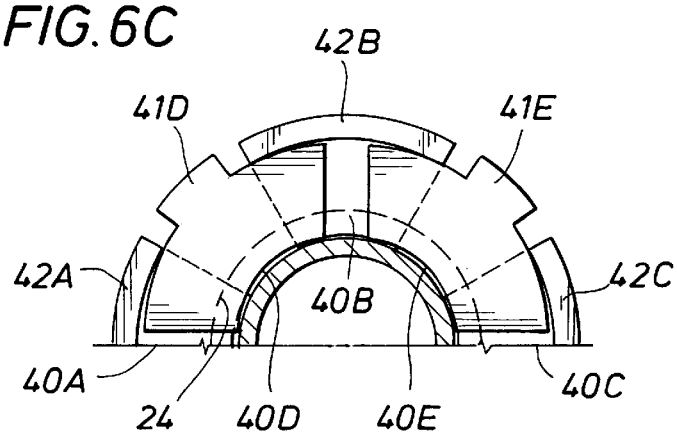
Figure 6D:
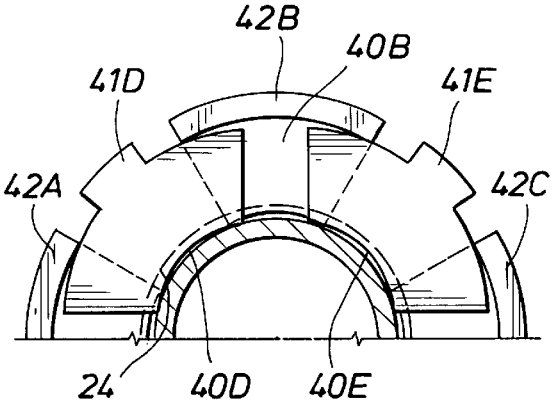
Figure 6E:
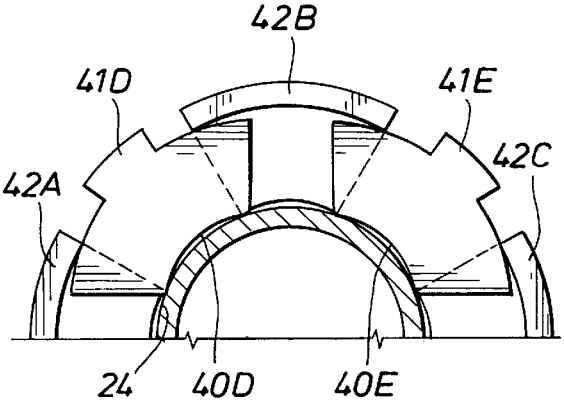

By way of example only, and as illustrated in FIGS. 6A to 6E, the insert segments are of such construction so as to facilitate closing about nominal pipe sizes of 2⅞" (FIG. 6A), 3½" (FIG. 6B), 4" (FIG. 6C), 4½" (FIG. 6D), and 5" (FIG. 6E). It will be understood from the description to follow, however, that the inserts are of a unique construction so as to facilitate not only preventing extrusion of the ram packer body in any of these positions, but also closing about pipes of sizes intermediate to those shown.

In the example shown in FIGS. 6A to 6E, when the packer body is relaxed to fit about a pipe of 3.5" diameter, the inner ends of all segments are arcuately aligned. As shown in FIGS. 1 to 4, the recess in the inner edges of the resilient body of the ram packer itself protrudes slightly inwardly from the inner edges of the inserts. As best shown in FIG. 3, the front edge of the resilient body of the packer protrudes from the front edges of the upper and lower plates 26 and 27, thus ensuring an initial seal with the pipe as well as the front face of the resilient body of the ram packer of the other ram. It should also be noted that the spacing of the rear edge of the plates inwardly from the rear edge of the resilient body of the ram packer enables the plate to be forced against the portion of the packer body behind it, thus causing the resilient material to be extruded in the manner described including its top ram packing 30 (FIG. 1) which extends across a groove in top of the metal ram body to connect at its opposite ends with the wings 29 on the ram packer thus forming a complete seal to prevent flow past the preventor.

In the position of FIG. 6B, the insert segments are overlapped, but nevertheless have their sides spaced apart to allow for circumferential movement to the position shown in FIG. 6A for closing about a smaller pipe of 2⅞" diameter. As noted in FIG. 6A, there is some misalignment of the front edges of the inserts, but the resulting unsupported area between them and the pipe is negligible.

FIG. 6C illustrates the positions of the inserts when they have been moved inwardly with the ram to close about a pipe of 4" diameter. In this case, the adjacent insert segments are actually spread circumferentially from the position of FIG. 6B, but nevertheless maintain their overlapping relation. Again, there is also some small gap between the inner ends of the inserts and the pipe, but not to any extent which would permit serious extrusion.

FIG. 6D shows the position of the inserts when the ram has been moved inwardly to close about a pipe 4½" in diameter. In this case, the adjacent segments are spread an even greater distance from that of FIG. 6C, but again maintain their overlapping relation, while minimizing the gap between their inner edges and the pipe.

Finally, FIG. 6E shows the inserts spread still further circumferentially to close about a pipe 5"in diameter, which approximates the recess in the upper and lower plates of the ram. Nevertheless, the adjacent inserts are still circumferentially overlapped, and the gap between their inner ends and the pipe is insignificant.

From the foregoing, it will also be understood that the circumferential overlap of the adjacent segments is maintained in all positions of the ram intermediate to those shown in FIGS. 6A through 6E, and thus, in the event it is necessary to move into sealing engagement about a pipe of a size intermediate those shown.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

I claim:

1. A blowout preventor, comprising:

a housing with a bore therethrough and opposed guideways extending from the bore, a pair of rams each comprising a metal body slidable within a guideway toward and away from the ram in the other guideway and having a slot across its front face intersected by a vertical recess, and a pair of ram packers each comprising a body of elastomeric material fitting closely within the slot in a ram body and having a vertical recess in its inner end symmetrical with and protruding from the recess in the ram body, so that the recesses in both close about a pipe in the bore of the housing as the ram move inwardly to closed position, metal plates embedded in the top and bottom surfaces of the packer body and each having a vertical recess therein generally symmetrical with the recess in the face of the packer body, and first and second sets of radially extending metal segments embedded within the packer body below only the top metal plate with their front edges forming a vertical recess generally symmetrical with and radially inwardly of the recess in the top metal plate but outwardly of the recess in the packer body, the segments of each set having generally radially extending side edges circumferentially spaced from one another and overlapping those of adjacent segments of the other set, when the packer body is in its relaxed condition, so as to prevent the formation of gaps through which the elastomeric material might extrude as the packer body is distorted upon closure of the recesses in the elastomeric packer bodies upon a range of pipe diameters greater as well as less than that of the diameter of the recess in the relaxed ram packer body.

2. A blowout preventor as set forth in claim 1, wherein each of the segments of the second set has a wedge-shaped rib on the one side thereof generally intermediate its side edges and which has essentially radially extending side edges which are disposed between and circumferentially spaced from essentially radially extending sides of adjacent wedge-shaped segments of the first set.

3. A blowout preventor as set forth in claim 2, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second set and adjacent the radially outer edges of adjacent segments of the second set to cause the segments of the second set to be moved inwardly with the segments of the first set.

4. A blowout preventor as set forth in claim 1, wherein the radially outer end edge of each segment of the second (yellow) set has an outwardly protruding portion generally intermediate its side edges, and each of the segments of the first set has a vertical flange on the radially outer end edge thereof intermediate the protruding portion on an adjacent segment of the second set and adjacent the radially outer edges of adjacent segments of the second set to cause the segments of the second set to be moved inwardly with the segments of the first set.

5. A blowout preventor as set forth in claim 1, wherein the radially inner end edges of the segments of both sets are curved to the same radius and vertically aligned with one another in the relaxed state of the elastomeric packer body.

6. For use in a blowout preventor having a housing with a bore therethrough and opposed guideways extending from the bore, a pair of rams each comprising a metal body slidable within one guideway toward and away from a ram in the other guideway and having a slot across its front face intersected by a vertical recess, a ram packer including a body of elastomeric material adapted to fit closely within the slot in the ram body and having a vertical recess in its inner end symmetrical with and protruding from the recess in the ram body, so that the recesses in both ram bodies close about a pipe in the bore of the housing as the rams move inwardly to closed position, metal plates embedded in the top and bottom surfaces of the packer body and each having a vertical recess therein generally symmetrical with the recess in the face of the packer body, and first and second sets of radially extending metal segments embedded within the packer body below only the top metal plate with their front edges forming a vertical recess generally symmetrical with and radially inwardly of the recess in the metal plate but outwardly of the recess in the packer body, the segments of each set having generally radially extending side edges circumferentially spaced from one another and overlapping those of adjacent segments of the other set, when the packer body is in its relaxed condition, so as to prevent the formation of gaps through which the elastomeric material might extrude as the packer body is distorted upon closure of the recesses in the elastomeric packer bodies upon a range of pipe diameters greater as well as less than that of the diameter of the recess in the relaxed ram packer body.

7. A pair of rams as set forth in claim 6, wherein, each of the segments of the second set has a wedge-shaped rib on the one side thereof generally intermediate its side edges and which has essentially radially extending side edges which are disposed between and circumferentially spaced from essentially radially extending sides of adjacent wedge-shaped segments of the first set.

8. A pair of rams as set forth in claim 8, wherein the radially outer end edge of each segment of the first set has an outwardly protruding portion generally intermediate its side edges, and each of the segments of the second set has a vertical flange on the radially outer end edge thereof intermediate the protruding portion on an adjacent segment of the first set and adjacent the radially outer edges, of adjacent segment of the first set to cause the segments of the first set to be moved inwardly with the segments of the second set.

9. A pair of rams as set forth in claim 6, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second set and adjacent the radially outer edges of adjacent segments of the second set to cause the segments of the second set to be moved inwardly with the segments of the first set.

10. A pair of rams as set forth in claim 6, wherein the radially inner end edges of the segments of both sets are curved to the same radius and vertically aligned with one another in the relaxed state of the elastomeric packer body.

11. For use in a blowout preventor having a housing with a bore therethrough and opposed guideways extending from the bore each to receive a ram including a metal body slidable within one guideway toward and away from a ram in the other guideway and having a slot across its front face intersected by a vertical recess, a pair of ram packers each comprising a body of elastomeric material adapted to fit closely within the slot in the ram body and having a vertical recess in its inner end symmetrical with and protruding from the recess in the ram body, so that the recesses in both packer bodies close about a pipe in the bore of the housing as the rams move inwardly to closed position, metal plates embedded in the top and bottom surfaces of the packer body and each having a vertical recess therein generally symmetrical with the recess in the face of the packer body, and first and second sets of radially extending metal segments embedded within the packer body below only the top metal plate with their front edges forming a vertical recess generally symmetrical with and radially inwardly of the recess in the metal plate, but outwardly of the recess in the packer body, the segments of each set having generally radially extending side edges circumferentially spaced from one another and overlapping those of adjacent segments of the other set, when the packer body is in its relaxed condition, so as to prevent the formation of gaps through which the elastomeric material might extrude as the packer body is distorted upon closure of the recesses in the elastomeric packer bodies upon a range of pipe diameters greater as well as less than that of the diameter of the recess in the relaxed ram packer body.

12. A pair of rams packers as set forth in claim 11, wherein each of the segments of the second set has a wedge-shaped rib on the one side thereof generally intermediate its side edges and which has essentially radially extending side edges which are disposed between and circumferentially spaced from essentially radially extending sides of adjacent wedge-shaped segments of the first set.

13. A pair of ram packers as set forth in claim 12, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second and adjacent the radially outer edges of adjacent segment of the first set to cause the segments of the second set to be moved inwardly with the segments of the first set.

14. A pair of ram packers as set forth in claim 11, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second set and adjacent the radially outer edges of adjacent segments of the second set to cause the segments of the second set to be moved inwardly with the segments of the first set.

15. A pair of ram packers as set forth in claim 11, wherein the radially inner end edges of the segments of both sets are curved to the same radius and vertically aligned with one another in the relaxed state of the elastomeric packer body.

16. A blowout preventor ram, comprising a metal body slidable within a guideway of a blowout preventor housing toward and away from a ram in an opposed guideway of the housing and having a slot across its front face intersected by a vertical recess, a body of elastomeric material fitting closely within the slot in the ram body and having a vertical recess in its inner end symmetrical with and protruding from the recess in the ram body, so that the recesses in both packed bodies close about a pipe in the bore of the housing as the rams move inwardly to closed position, metal plates embedded in the top and bottom surfaces of the packer body and each having a vertical recess therein generally symmetrical with the recess in the face of the packer body, and first and second sets of radially extending metal segments embedded within the packer body below only the top metal plate with their front edges forming a vertical recess generally symmetrical with and radially inwardly of the recess in the metal plate but outwardly of the recess in the packer body, the segments of each set having generally radially extending side edges circumferentially spaced from one another and overlapping those of adjacent segments of the other set, when the packer body is in its relaxed condition, so as to prevent the formation of gaps through which the elastomeric material might extrude as the packer body is distorted upon closure of the recesses in the elastomeric packer bodies upon a range of pipe diameters greater as well as less than that of the diameter of the recess in the relaxed ram packer body.

17. A ram as set forth in claim 16, wherein, each of the segments of the second set has a wedge-shaped rib on the one side thereof generally intermediate its side edges and which has essentially radially extending side edges which are disposed between and circumferentially spaced from essentially radially extending sides of adjacent wedge-shaped segments of the first set.

18. A ram as set forth in claim 16, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second set and adjacent the radially outer edges, of adjacent segment of the second set to cause the segments of the first set to be moved inwardly with the segments of the first set.

19. A ram as set forth in claim 16, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second set and adjacent the radially outer edges of adjacent segment of the second set to cause the segments of the second set to be moved inwardly with the segments of the first set.

20. A ram as set forth in claim 16, wherein the radially inner end edges of the segments of both sets are curved to the same radius and vertically aligned with one another in the relaxed state of the elastomeric packer body.

21. A packer for a blowout preventor ram, comprising a body of elastomeric material adapted to fit closely within a slot in the front face of a metal ram body and having a vertical recess in its inner end adapted to be symmetrical with and protruding from the recess in the metal ram body, when so fitted, whereby the recesses in both packer bodies close about a pipe in the bore of the housing as the rams move inwardly to closed position, metal plates embedded in the top and bottom surfaces of the packer body and each having a vertical recess therein generally symmetrical with the recess in the face of the packer body, and first and second sets of radially extending metal segments embedded within the packer body below only the top metal plate with their front edges forming a vertical recess generally symmetrical with and inwardly of the recess in the metal plate but outwardly of the recess in the metal plate but outwardly of the recess in the packer body, the segments of each set having generally radially extending side edges circumferentially spaced from one another and overlapping those of adjacent segments of the other set, when the packer body is in its relaxed condition, so as to prevent the formation of gaps through which the elastomeric material might extrude as the packer body is distorted upon closure of the recesses in the elastomeric bodies upon a range of pipe diameters greater as well as less than that of the diameter of the recess in the relaxed ram packer body.

22. A packer as set forth in claim 21, wherein each of the segments of the second set has a wedge-shaped rib on the one side thereof generally intermediate its side edges and which has essentially radially extending side edges which are disposed between and circumferentially spaced from essentially radially extending sides of adjacent wedge-shaped segments of the first set.

23. A packer as set forth in claim 22, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second set and adjacent the radially outer edges, of adjacent segment of the second set to cause the segments of the second set to be moved inwardly with the segments of the second set.

24. A packer as set forth in claim 21, wherein the radially outer end edge of each segment of the second set has an outwardly protruding portion generally intermediate its side edges, and each of the segments of the first set has a vertical flange on the radially outer end edge thereof intermediate the protruding portion on an adjacent segment of the second set and adjacent the radially outer edges of adjacent segment of the second set to cause the segments of the second set to be moved inwardly with the segments of the first set.

25. A packer as set forth in claim 21, wherein the radially inner end edges of the segments of both sets are curved to the same radius and vertically aligned with one another in the relaxed state of the elastomeric packer body.

* * * * *